US006819334B1

(12) United States Patent
Owada et al.

(10) Patent No.: US 6,819,334 B1
(45) Date of Patent: Nov. 16, 2004

(54) INFORMATION PROCESSING APPARATUS AND ITS DISPLAY CONTROLLER

(75) Inventors: Toru Owada, Yokohama (JP); Isao Takita, Yokohama (JP); Yasushi Nagai, Yokohama (JP); Kanetoshi Saito, Yokohama (JP); Takuichiro Nakazawa, Higashimurayama (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/517,585

(22) Filed: Mar. 3, 2000

(30) Foreign Application Priority Data

Mar. 23, 1999 (JP) ..... 11-077229

(51) Int. Cl.[7] ..... G09G 5/00
(52) U.S. Cl. ..... 345/659; 345/649
(58) Field of Search ..... 345/649, 659

(56) References Cited

U.S. PATENT DOCUMENTS 4,542,377 A * 9/1985 Hagen et al. ..... 345/649
4,554,638 A * 11/1985 Iida ..... 345/658
5,617,113 A * 4/1997 Prince ..... 345/103
5,798,750 A * 8/1998 Ozaki ..... 345/656
5,956,049 A * 9/1999 Cheng ..... 345/568
5,973,664 A * 10/1999 Badger ..... 345/649
5,995,167 A * 11/1999 Fukushima et al. ..... 348/714
6,189,064 B1 * 2/2001 MacInnis et al. ..... 710/244
6,310,986 B2 * 10/2001 Robey et al. ..... 382/296
6,407,746 B1 * 6/2002 Tanizawa ..... 345/649
6,639,603 B1 * 10/2003 Ishii ..... 345/568

FOREIGN PATENT DOCUMENTS

JP A-6-289848 * 10/1994 ..... G09G/5/40

* cited by examiner

*Primary Examiner*—Michael Razavi
*Assistant Examiner*—Motilewa Good-Johnson
(74) *Attorney, Agent, or Firm*—Antonelli, Terry, Stout & Kraus, LLP

(57) ABSTRACT

An information processing apparatus has a processing unit, a memory unit for storing display data processed by the processing unit, a display image rotation engine which is coupled with a buffer memory to sequentially transfer display data to the buffer memory and which responds to a command of predetermined timing for display data update to store the display data stored in the memory unit in read sequence different from write sequence, a display controller for delivering the display data, stored in the buffer memory, in the memory unit by means of the rotation engine to a display device, and a bus for mutually coupling the processing unit, the memory unit, the display controller and the rotation engine.

12 Claims, 17 Drawing Sheets

FIG. 10A

DISPLAY DATA PIECES IN DISPLAY DATA AREA FOR SYSTEM

| | | | | | | | |
|---|---|---|---|---|---|---|---|
| | | | | | | | |
| | | | | | | | |
| | | | | | | | |
| | | | | | | | |
| | | | | | | | |
| | | | | | | | |
| | | | | | | | |
| | | | | | | | |
| 03 | 13 | 23 | 33 | | | | |
| 02 | 12 | 22 | 32 | | | | |
| 01 | 11 | 21 | 31 | | | | |
| 00 | 10 | 20 | 30 | | | | |

FIG. 10B

DISPLAY DATA PIECES ON BUFFER MEMORY INPUT SEQUENCE
(03,13,23,33),(02,12,22,32),···,(00,10,20,30)

UNIT WIDTH OF DATA TRANSFER THROUGH BURST ACCESS OPERATION

| | | | |
|---|---|---|---|
| 03 | 13 | 23 | 33 |
| 02 | 12 | 22 | 32 |
| 01 | 11 | 21 | 31 |
| 00 | 10 | 20 | 30 |

THE NUMBER OF PIXELS TRANSFERRED THROUGH ONE BURST ACCESS OPERATION

OUTPUT SEQUENCE
(00,01,02,03),(10,11,12,13),···,(30, 31, 32, 33)

FIG. 10C

DISPLAY DATA PIECES IN DISPLAY DATA AREA FOR DISPLAY DEVICE

| | | | | | | | | | | | |
|---|---|---|---|---|---|---|---|---|---|---|---|
| 00 | 01 | 02 | 03 | | | | | | | | |
| 10 | 11 | 12 | 13 | | | | | | | | |
| 20 | 21 | 22 | 23 | | | | | | | | |
| 30 | 31 | 32 | 33 | | | | | | | | |
| | | | | | | | | | | | |
| | | | | | | | | | | | |
| | | | | | | | | | | | |
| | | | | | | | | | | | |

FIG. 12A

DISPLAY DATA PIECES ON SYSTEM MEMORY

| | | | | | | | | | | | |
|---|---|---|---|---|---|---|---|---|---|---|---|
| 00 | 01 | 02 | 03 | 04 | 05 | 06 | 07 | 08 | | | 0m |
| 10 | 11 | 12 | 13 | 14 | 15 | 16 | 17 | 18 | | | 1m |
| 20 | 21 | 22 | 23 | 24 | 25 | 26 | 27 | 28 | | | 2m |
| 30 | 31 | 32 | 33 | 34 | 35 | 36 | 37 | 38 | | | 3m |
| 40 | 41 | 42 | 43 | 44 | 45 | 46 | 47 | 48 | | | 4m |
| | | | | | | | | | | | |
| | | | | | | | | | | | |
| n0 | n1 | n2 | n3 | n4 | n5 | n6 | n7 | n8 | | | nm |

FIG. 12B

DISPLAY DATA PIECES ON BUFFER MEMORY (TIME 0)
MEMORY 1 : INPUT

| | | | | | | | | | | | |
|---|---|---|---|---|---|---|---|---|---|---|---|
| 00 | 01 | 02 | 03 | 04 | 05 | 06 | 07 | 08 | | | 0m |

INPUT SEQUENCE (00, 01, 02, 03), (04, 05, 06, 07), ···

MEMORY 2 : OUTPUT

| | | | | | | | | | | | |
|---|---|---|---|---|---|---|---|---|---|---|---|
| - | - | - | - | - | - | - | - | - | - | - | - |

FIG. 12C

DISPLAY DATA PIECES ON BUFFER MEMORY (TIME 1)
MEMORY 1 : OUTPUT

| | | | | | | | | | | | |
|---|---|---|---|---|---|---|---|---|---|---|---|
| 00 | 01 | 02 | 03 | 04 | 05 | 06 | 07 | 08 | | | 0m |

OUTPUT SEQUENCE 00, 01, 02, 03, 04, 05, 06, 07, ···

MEMORY 2 : INPUT

| | | | | | | | | | | | |
|---|---|---|---|---|---|---|---|---|---|---|---|
| 10 | 11 | 12 | 13 | 14 | 15 | 16 | 17 | 18 | | | 1m |

FIG. 12D

DISPLAY DATA PIECES ON BUFFER MEMORY (TIME n+1)
MEMORY 1 : INPUT

| | | | | | | | | | | | |
|---|---|---|---|---|---|---|---|---|---|---|---|
| 00 | 01 | 02 | 03 | 04 | 05 | 06 | 07 | 08 | | | 0m |

MEMORY 2 : OUTPUT

| | | | | | | | | | | | |
|---|---|---|---|---|---|---|---|---|---|---|---|
| n0 | n1 | n2 | n3 | n4 | n5 | n6 | n7 | n8 | | | nm |

FIG. 12E

DISPLAY DATA PIECES ON DISPLAY DEVICE

| | | | | | | | | | | | |
|---|---|---|---|---|---|---|---|---|---|---|---|
| 00 | 01 | 02 | 03 | 04 | 05 | 06 | 07 | 08 | | | 0m |
| 10 | 11 | 12 | 13 | 14 | 15 | 16 | 17 | 18 | | | 1m |
| 20 | 21 | 22 | 23 | 24 | 25 | 26 | 27 | 28 | | | 2m |
| 30 | 31 | 32 | 33 | 34 | 35 | 36 | 37 | 38 | | | 3m |
| 40 | 41 | 42 | 43 | 44 | 45 | 46 | 47 | 48 | | | 4m |
| | | | | | | | | | | | |
| | | | | | | | | | | | |
| n0 | n1 | n2 | n3 | n4 | n5 | n6 | n7 | n8 | | | nm |

OUTPUT SEQUENCE 00, 01, ···, 0n, 10, 11, ···, 1n, 20, 21, ···, 2n, ···

FIG. 13A

DISPLAY DATA PIECES ON SYSTEM MEMORY

| 0m | 1m | 2m | 3m | 4m | | | nm |
|---|---|---|---|---|---|---|---|
| | | | | | | | |
| | | | | | | | |
| 08 | 18 | 28 | 38 | 48 | | | n8 |
| 07 | 17 | 27 | 37 | 47 | | | n7 |
| 06 | 16 | 26 | 36 | 46 | | | n6 |
| 05 | 15 | 25 | 35 | 45 | | | n5 |
| 04 | 14 | 24 | 34 | 44 | | | n4 |
| 03 | 13 | 23 | 33 | 43 | | | n3 |
| 02 | 12 | 22 | 32 | 42 | | | n2 |
| 01 | 11 | 21 | 31 | 41 | | | n1 |
| 00 | 10 | 20 | 30 | 40 | | | n0 |

FIG. 13B

DISPLAY DATA PIECES ON BUFFER MEMORY(TIME 0)

MEMORY 1 : INPUT MEMORY 2 : OUTPUT

UNIT WIDTH OF DATA TRANSFER THROUGH BURST ACCESS OPERATION

| 0m | 1m | 2m | 3m |
|---|---|---|---|
| | | | |
| | | | |
| 08 | 18 | 28 | 38 |
| 07 | 17 | 27 | 37 |
| 06 | 16 | 26 | 36 |
| 05 | 15 | 25 | 35 |
| 04 | 14 | 24 | 34 |
| 03 | 13 | 23 | 33 |
| 02 | 12 | 22 | 32 |
| 01 | 11 | 21 | 31 |
| 00 | 10 | 20 | 30 |

| - | - | - | - |
|---|---|---|---|
| - | - | - | - |
| - | - | - | - |
| - | - | - | - |
| - | - | - | - |
| - | - | - | - |
| - | - | - | - |
| - | - | - | - |
| - | - | - | - |
| - | - | - | - |
| - | - | - | - |
| - | - | - | - |

THE NUMBER OF PIXELS ON ONE HORIZONTAL DISPLAY LINE

INPUT SEQUENCE (0m,1m,2m,3m),···,(08,18,28,38),(07,17,27,37),···

FIG. 13C

DISPLAY DATA PIECES ON BUFFER MEMORY(TIME 1)

MEMORY 1 : OUTPUT

| 0m | 1m | 2m | 3m |
|---|---|---|---|
| | | | |
| | | | |
| 08 | 18 | 28 | 38 |
| 07 | 17 | 27 | 37 |
| 06 | 16 | 26 | 36 |
| 05 | 15 | 25 | 35 |
| 04 | 14 | 24 | 34 |
| 03 | 13 | 23 | 33 |
| 02 | 12 | 22 | 32 |
| 01 | 11 | 21 | 31 |
| 00 | 10 | 20 | 30 |

MEMORY 2 : INPUT

| 4m | 5m | 6m | 7m |
|---|---|---|---|
| | | | |
| | | | |
| 48 | 58 | 68 | 78 |
| 47 | 57 | 67 | 77 |
| 46 | 56 | 66 | 76 |
| 45 | 55 | 65 | 75 |
| 44 | 54 | 64 | 74 |
| 43 | 53 | 63 | 73 |
| 42 | 52 | 62 | 72 |
| 41 | 51 | 61 | 71 |
| 40 | 50 | 60 | 70 |

OUTPUT SEQUENCE 00,01,02,03,···,0m, 10,11,12,13,···,1m,···

FIG. 13D

DISPLAY DATA PIECES ON BUFFER MEMORY(TIME (n+1) / 4)

MEMORY 1 : INPUT

| 0m | 1m | 2m | 3m |
|---|---|---|---|
| | | | |
| | | | |
| 08 | 18 | 28 | 38 |
| 07 | 17 | 27 | 37 |
| 06 | 16 | 26 | 36 |
| 05 | 15 | 25 | 35 |
| 04 | 14 | 24 | 34 |
| 03 | 13 | 23 | 33 |
| 02 | 12 | 22 | 32 |
| 01 | 11 | 21 | 31 |
| 00 | 10 | 20 | 30 |

MEMORY 2 : OUTPUT

| | | | nm |
|---|---|---|---|
| | | | |
| | | | |
| | | | n8 |
| | | | n7 |
| | | | n6 |
| | | | n5 |
| | | | n4 |
| | | | n3 |
| | | | n2 |
| | | | n1 |
| | | | n0 |

FIG. 13E

DISPLAY DATA PIECES ON DISPLAY DEVICE

| 00 | 01 | 02 | 03 | 04 | 05 | 06 | 07 | 08 | | | 0m |
|---|---|---|---|---|---|---|---|---|---|---|---|
| 10 | 11 | 12 | 13 | 14 | 15 | 16 | 17 | 18 | | | 1m |
| 20 | 21 | 22 | 23 | 24 | 25 | 26 | 27 | 28 | | | 2m |
| 30 | 31 | 32 | 33 | 34 | 35 | 36 | 37 | 38 | | | 3m |
| 40 | 41 | 42 | 43 | 44 | 45 | 46 | 47 | 48 | | | 4m |
| | | | | | | | | | | | |
| | | | | | | | | | | | |
| n0 | n1 | n2 | n3 | n4 | n5 | n6 | n7 | n8 | | | nm |

INFORMATION PROCESSING APPARATUS AND ITS DISPLAY CONTROLLER

BACKGROUND OF THE INVENTION

The present invention relates to an information processing apparatus such as personal computer (PC) and its display controller and more particularly, to rotation display of display data in the information processing apparatus.

A method for rotation display of display data has hitherto been known as described in, for example, JPA-6-289848 in which one address generation method is switched to another.

In the above prior art, a display address generator 16051 for controlling the address of a VRAM 1606 is provided in a display controller 1605 as shown in FIG. 16 and when a rotation display is instructed by a CPU 1601, the display address generator 16051 switches one display address generation method to another so that the VRAM 1606 may be accessed through an address bus 16053. Besides, by causing a display control unit 16052 to convert the bit sequence of the display data, the contents of the VRAM 1606 can be 180° rotated and displayed. In this manner, the prior art realizes rotation display at a higher speed than that in a scheme in which rewrite operation is effected through software.

SUMMARY OF THE INVENTION

With the prior art method for rotation display, 180° rotation can be implemented easily without sacrificing the display performance but 90° rotation display and 270° rotation display can be implemented only at the cost of the display performance.

Typically, a DRAM is used as VRAM 1606 and with the aim of improving the speed of data transfer to the display controller, the VRAM 1606 is accessed through a burst access to the DRAM. The burst access is a memory access method for sequential write and read of data. The burst access is permissible only for addresses on the same row of the DRAM. In the 180° rotation display, the sequence of display data access is in the row address direction like the normal display and therefore the burst access to the DRAM can be utilized without affecting the display performance. But in the case of the 90° and 270° rotation displays, the sequence of display data access is in the column address direction and the burst access to the DRAM cannot be utilized. Accordingly, in this case, display data is read out by a single access to the DRAM and the speed of data transfer to the display controller is decreased to degrade the display performance.

Therefore, an object of the present invention is to provide a display controller or an information processing apparatus which can execute 90°, 180° and 270° rotation displays without sacrificing the display performance.

To accomplish the above object, according to the present invention, an information processing apparatus comprises:

a processing unit;

a memory unit for storing display data processed by the processing unit;

a display image rotation engine which is coupled with a buffer memory to sequentially transfer display data to the buffer memory and which responds to a command of predetermined timing for display data update to store the display data, stored in the buffer memory, in the memory unit in read sequence different from write sequence;

a display controller for delivering the display data stored in the memory unit by means of the rotation engine to a display device; and a bus for mutually coupling the processing unit, the memory unit, the display controller and the rotation engine.

In an embodiment of the present invention, the display image rotation engine is coupled to a buffer memory having n*n+n areas each being adapted to store display data pieces corresponding to m/n*L/n pixels, where L is a predetermined number of pixels in the display data on the same row, m is the number of rows and n is a numeral for equally dividing each of the L and m, and while sequentially writing display data pieces for m rows in a unit of L pixels to the n*n areas, reads display data pieces for m pixels on the same column, column by column, from the remaining n areas and writes sequentially display data pieces to the n areas for which read operation has ended.

In another embodiment of the invention, the display image rotation engine is coupled with a buffer memory having a plurality of areas each storing display data pieces corresponding in number to (a predetermined number L of pixels of the display data on the same row)*(the number m of rows) and while writing display data pieces for m rows in a unit of L pixels to one area, reads display data pieces for m pixels on the same column, column by column, from the other area.

BRIEF DESCRIPTION OF THE DRAWINGS

FIGS. 10A–10C are diagrams showing the simplified relation between display data on a system memory and display data on a buffer memory used by a display image rotation engine to work rotation processing.

FIGS. 12A–12E are diagrams showing the arrangement of display data on a system memory, display data on a buffer memory and display data delivered to a display device when normal display is carried out in the second embodiment.

FIGS. 13A–13E are diagrams showing the arrangement of display data on the system memory, display data on the buffer memory and display data delivered to the display device when rotation display is carried out in the second embodiment.

DESCRIPTION OF THE EMBODIMENTS

Preferred embodiments of the present invention will now be described with reference to the accompanying drawings.

Figure 1:
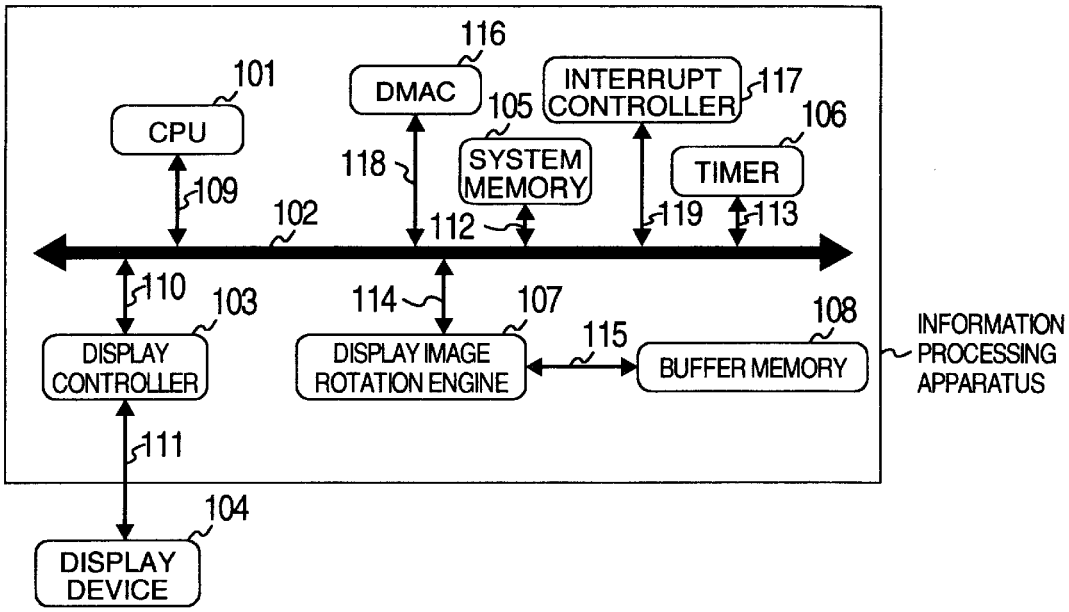
FIG. 1 is a diagram showing an outline of hardware construction of an information processing apparatus according to a first embodiment of the present invention.

Referring first to FIGS. 1 to 10, a first embodiment of an information processing apparatus according to the invention will be described. The information processing apparatus is represented by, for example, a PC and only components thereof having relation to the processing in the present embodiment are illustrated in FIG. 1 showing an outline of construction of the information processing apparatus. Especially, the hardware construction of the present embodiment will be described briefly with reference to FIG. 1.

As shown in FIG. 1, the first embodiment of the information processing apparatus according to the invention comprises a central processing unit (hereinafter simply referred to as a CPU) 101, a system bus 102 for transmission of control instructions and data, a display device 104 for displaying display data, a display controller 103 for transferring the display data to the display device 104, a system memory 105 which the CPU 101 uses to store the control instructions, system data and the display data, a timer 106 which is set by the CPU 101 to measure time and which, after a lapse of predetermined time, informs the CPU 101 of the instructed time lapse, a display image rotation engine for reading the display data on the system memory 105, applying a rotation process to the read display data and writing the processed data to the system memory 105, a buffer memory 108 which the display image rotation engine 107 uses to work the rotation process, a direct memory access controller (hereinafter referred to as a DMAC) 116 which follows a command by the CPU 101 to implement data transfer among the system memory 105, display controller 103 and rotation engine 107, and an interrupt controller 117 which follows a command by the rotation engine 107 to request the CPU 101 to execute an interrupt process. Denoted by 109 to 115, 118 and 119 are data buses and control signal buses for interchange of data and control signals among the individual component units. The rotation process carried out by the rotation engine 107 is for changing the sequence of pieces of display data during reading in relation to the sequence of pieces of display data during writing.

Normal display operation will first be described by making reference to FIG. 1.

The CPU 101 writes display data to the system memory 105 by way of the system bus 102. The data write operation occurs each time that the contents of display is updated. The frequency of update operation is not constant. For example, when a specified image is kept to be displayed on the display device 104, the aforementioned display data write operation does not occur. But when an animation is displayed on the display device 104, the display data write operation occurs at a frequency conforming to the number of frames in animation data.

The display controller 103 reads the display data from the system memory 105 periodically at a frequency required by the display device 104 and delivers the read data to the display device 104. This periodic read/delivery (write) operation continues to be executed regardless of the presence or absence of change of the display contents as far as display on the display device 104 is carried out continuously.

Figure 2A:
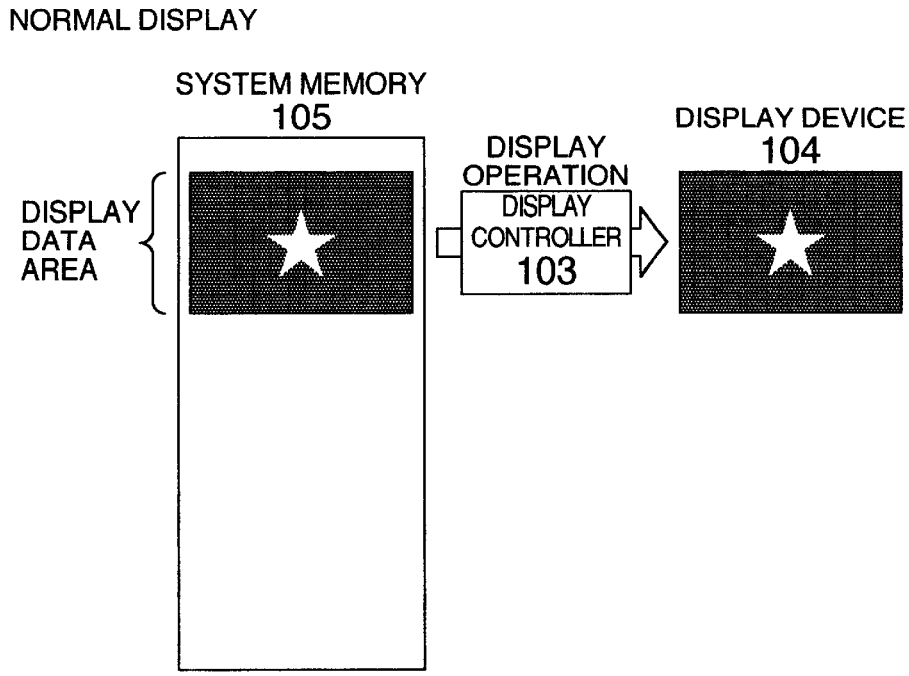
FIGS. 2A and 2B are diagrams showing the concepts of normal display and rotation display in the first embodiment.
Figure 2B:
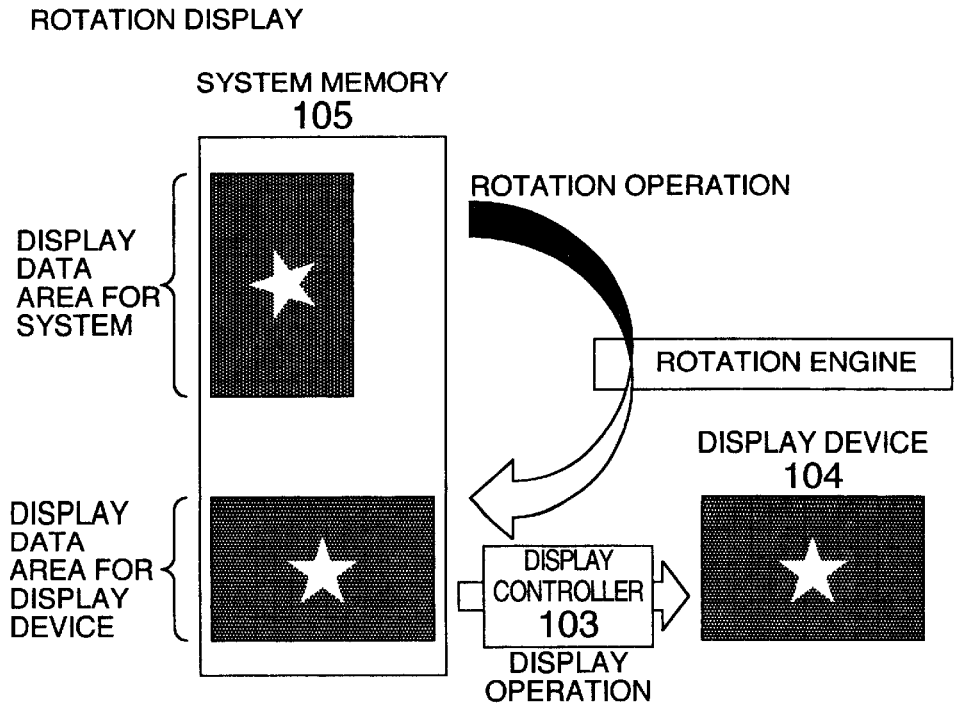

Turning to FIGS. 2A and 2B, the concepts of normal display or non-rotation display and rotation display in the information processing apparatus according to the present embodiment will be described. In conceptual diagrams of FIGS. 2A and 2B, the concept of normal display and the concept of rotation display are depicted, respectively.

In the information processing apparatus of the present embodiment, the display data are stored on the system memory 105 in coexistence with the control instructions and system data used by the CPU but the display data is saved in a specified area on the system memory 105 to facilitate the management of the display data. In FIGS. 2A and 2B, this area is indicated as display data area.

As shown in FIG. 2A, in normal display, the CPU 101 first writes display data corresponding to a display resolution of, for example, x*y pixels to the display data area on the system memory 105. The display data is read by the display controller 103 and displayed on the display device 104 having a display resolution of x*y pixels. Contrarily, in rotation display of FIG. 2B, the CPU 101 writes display data corresponding to a display resolution of, for example, y*x pixels to a display data area for system. This display data is rotated through, for example, 90° in this example by means of the rotation determined to be for update of display data, a display data update occurrence flag is set in step 303.

Prior to giving a detailed description of the rotation display operation carried out by the display image rotation engine, a process of updating display data for system will be described with reference to FIGS. 3, 5 and 7. The rotation display operation presupposes the system display data update process which includes update decision, update timing determination and update execution.

Figure 3:
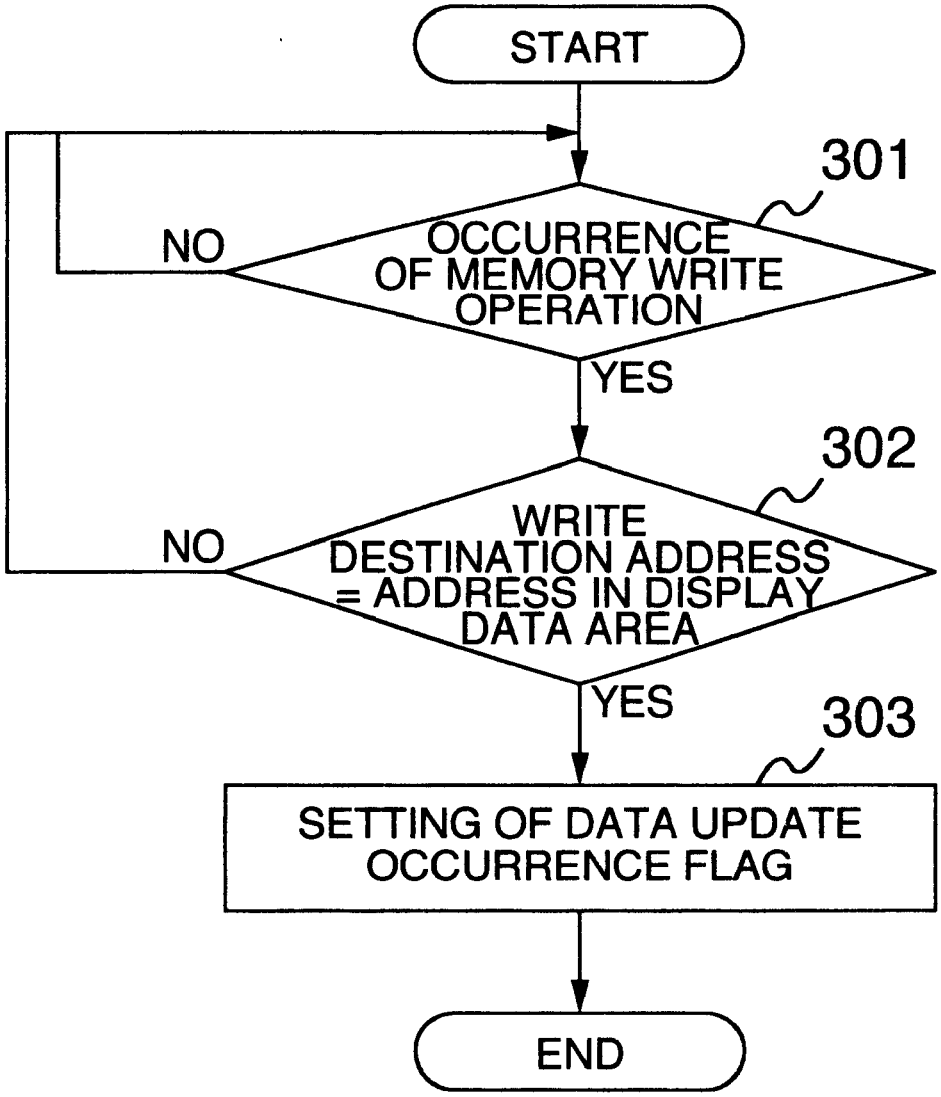
FIG. 3 is a simplified flow chart of an example of system display data update decision in the first embodiment.

A simplified flow chart of the update decision in the information processing apparatus of the present embodiment is shown in FIG. 3.

Referring to FIG. 3, the rotation engine 107 searches a write access by the CPU to the system memory 105 by monitoring memory control signals on the system bus 102 in step 301. When a memory write operation is detected, a memory address of a write destination is compared with a memory address in the system display data area in step 302 to decide whether the memory write access is for update of display data. If the write destination address coincides with the address in the display data area and the memory write access is determined to be for update of display data, a display data update occurrence flag is set in step 303.

Figure 5:
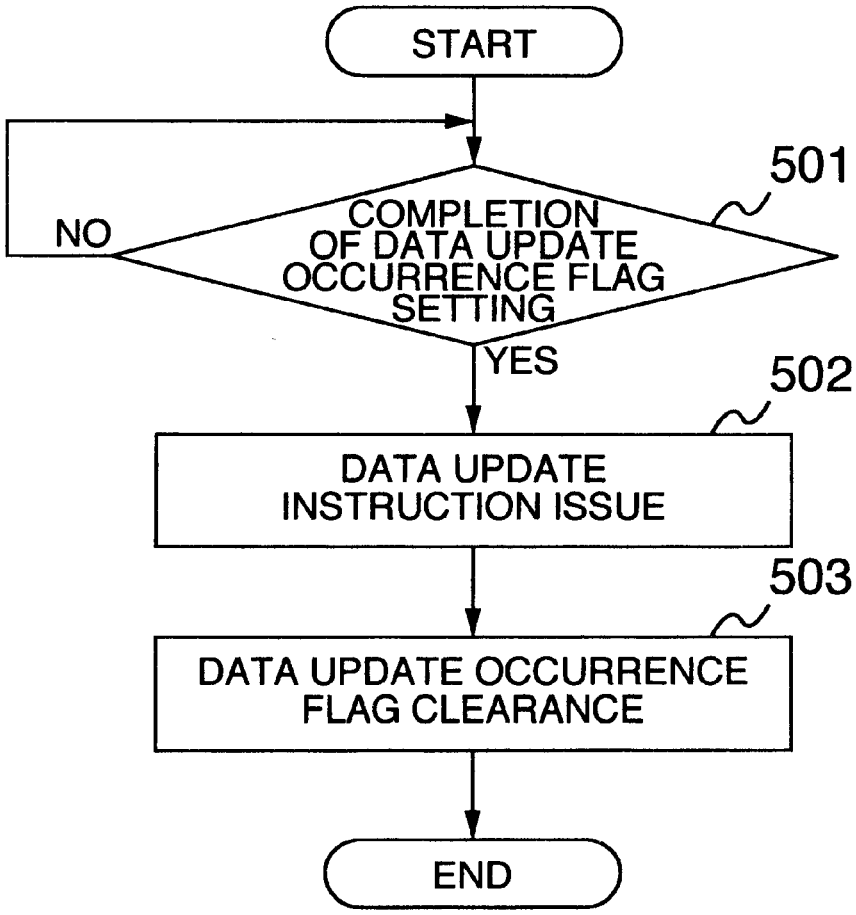
FIG. 5 is a simplified flow chart of an example of display data update timing determination in the first embodiment.

A simplified flow chart of display data update timing determination is shown in FIG. 5. Next, display device display data update timing determination will be described with reference to FIG. 5.

In step 501, the rotation engine 107 monitors whether the display data update occurrence flag is set. If the display data update occurrence flag is set, a data update instruction is issued in step 502 and at the same time, the display data update occurrence flag is cleared in step 503. In other words, the display data update occurrence flag is sequentially monitored and when the flag is set, the data update instruction is issued.

Figure 7:
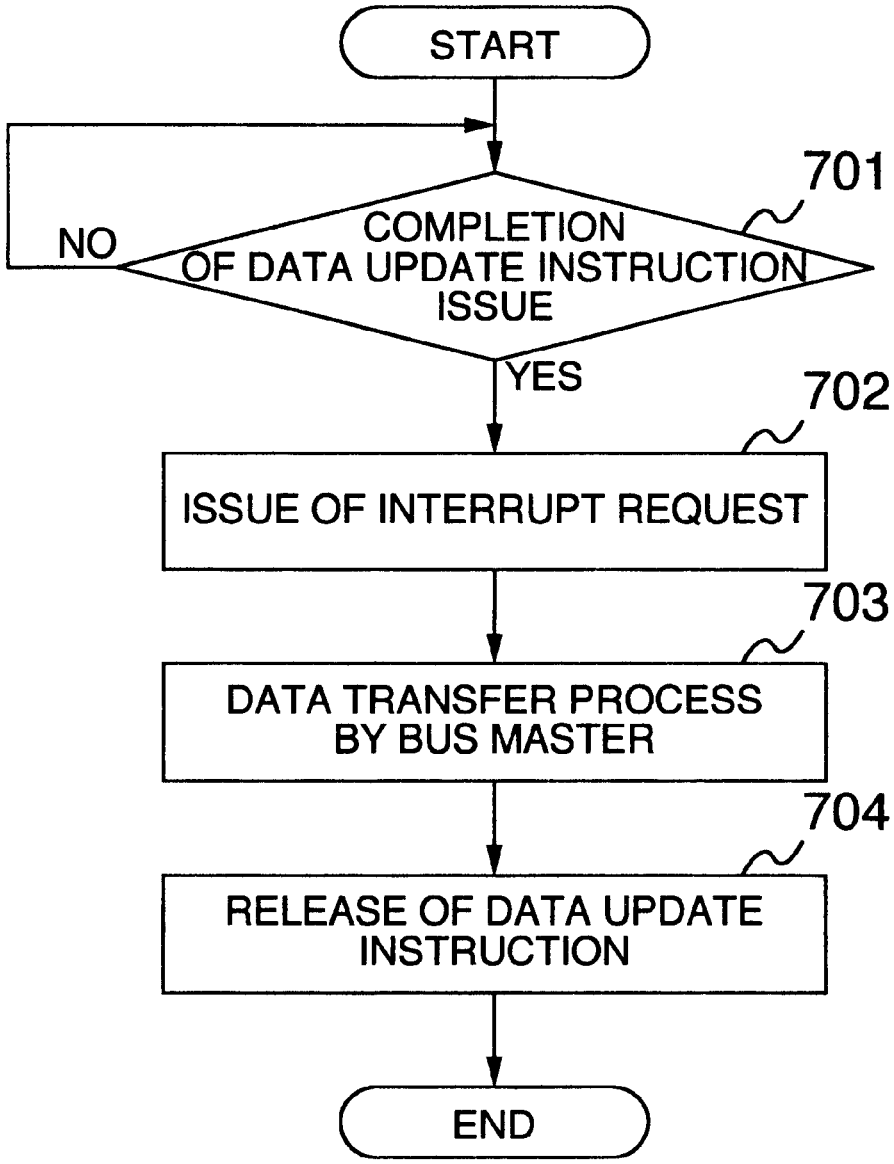
FIG. 7 is a simplified flow chart of an example of display data update execution in the first embodiment.

A simplified flow chart of data update execution is shown in FIG. 7.

In step 701, the rotation engine 107 monitors the presence or absence of a data update instruction issued and if the data update instruction is issued, it requests the interrupt controller 117 to perform an interrupt process in step 702. Responsive to this request, the interrupt controller 117 makes a request for interrupt to the CPU 101, so that the CPU 101 or the DMAC 116 acts as a bus master to carry out transfer of necessary display data between the system memory 105 and the rotation engine 107 in step 703. After the transfer of necessary display data has ended, the rotation engine 107 releases the data update instruction in step 704. Namely, the rotation engine 107 makes the request for interrupt to request the CPU 101 or the DMAC 116 to perform the display data update process and update of data within the display data area for display device is executed by the bus master other than the rotation engine 107.

As described above, in the information processing apparatus of the present embodiment, by carrying out operations in sequence of the flow charts shown in FIGS. 3, 5 and 7, the display data written in the display area for system by the CPU 101 is read by the rotation engine 107. Thereafter, the display data can be 90° rotated and that display data can be rewritten to the display data area for display device. Then, by transferring the display data within the display data area for display device to the display device, the data obtained by 90° rotating the original display data can be displayed on the display device 104.

The rotation engine 107 works to implement the rotation process by using the buffer memory 108 having a structure to be described below with reference to FIGS. 10A–10C showing the relation between display data on the system memory and display data on the buffer memory 108.

Display data stored in the display data area for system on the system memory 105 is illustrated in FIG. 10A and display data stored in the display data area for display device is illustrated in FIG. 10B. For simplification of explanation, it is assumed that a piece of display data corresponding to one pixel of the display device 104 is stored at one address and the width of the data piece stored at one address is identical to the bus width of the system bus 102. In the drawing, the horizontal direction corresponds to the direction of addresses on the same row. When a DRAM is used as system memory 105, only data pieces on the same row can be subjected to execution of burst access capable of performing sequential data read and data write.

The number of burst access operations in which the best data transfer efficiency can be obtained is determined depending on the system construction but for simplicity of explanation, it is assumed that the number of burst transfer operations between the rotation engine 107 and the system memory 105 is four per access.

In this case, the buffer memory 108 has a structure for storage of 4×4 display data pieces as shown in FIG. 10B. This 4×4 area is defined as a unit of transfer between the system memory 105 and the buffer memory 108 to ensure that the best data transfer efficiency of the system bus 102 can be obtained and the memory capacity of the buffer memory 108 can be saved.

When 4×4 display data pieces shown in FIG. 10A are subjected to rotation display, display data pieces to be stored in the display data area for display device are arranged as shown in FIG. 10C. To this end, the rotation engine 107 reads data pieces from the system memory 105 through individual burst access operations in order of (03, 13, 23, 33), (02, 12, 22, 32), . . . , (00, 10, 20, 30) conforming to the input sequence indicated in FIG. 10B. These display data pieces are saved by means of the rotation engine 107 in the buffer memory as illustrated at (b) and then written to the display data area for display device through individual burst operations in order of (00, 01, 02, 03), (10, 11, 12, 13), . . . , (30, 31, 32, 33) conforming to the output sequence indicated in FIG. 10B.

As described above, by using the square buffer memory having a length of one side corresponding to a capacity of display data pieces transferred between the system memory 105 and the buffer memory 108 through the determined number of burst transfer operations, the high data transfer efficiency can be ensured and the buffer memory capacity can be saved.

In the above explanation given by using FIG. 10, an instance is described for simplicity of explanation in which one pixel data piece is stored at one address and the data width of one address is identical to the bus width of the system bus 102. But even when the above presupposition is not met, a buffer memory capable of permitting the high data transfer efficiency and the memory capacity saving can be constructed by making the buffer memory have a square form having a length of one side corresponding to a capacity of display data pieces transferred between the system memory 105 and the buffer memory 108 through the determined number of burst transfer operations and changing the order of data pieces secured in the rotation engine 107 by burst transfer, within the bus width or width of a data piece at one address.

The method for 90° rotating the display data has been described in the above explanation by making reference to FIG. 10 but by changing the data read and data write directions, 180° rotation and 270° rotation can be realized with ease.

As described above, according to the present embodiment, in the system in which the control instructions, system data and display data coexist in the system memory 105, the information processing apparatus and its display controller can be provided which can permit the rotation display by using the buffer memory of small capacity without increasing the band of the system bus. Further, since addresses of data pieces after the rotation are determined by changing the output sequence of display data stored in the buffer memory in relation to the input sequence of the display data, the CPU can be less loaded as compared to the case of the rotation based on software in which addresses after rotation are determined by the CPU.

The system display data update process has been described with reference to FIGS. 3, 5 and 7. Here, different examples of the system display data update process according to the invention will be described with reference to FIGS. 4, 6, 8 and 9.

In FIG. 3, the occurrence of display data update is determined by a write access to the display data area for system. A different example of the display data update decision is carried out in accordance with a simplified flow chart shown in FIG. 4.

Figure 4:
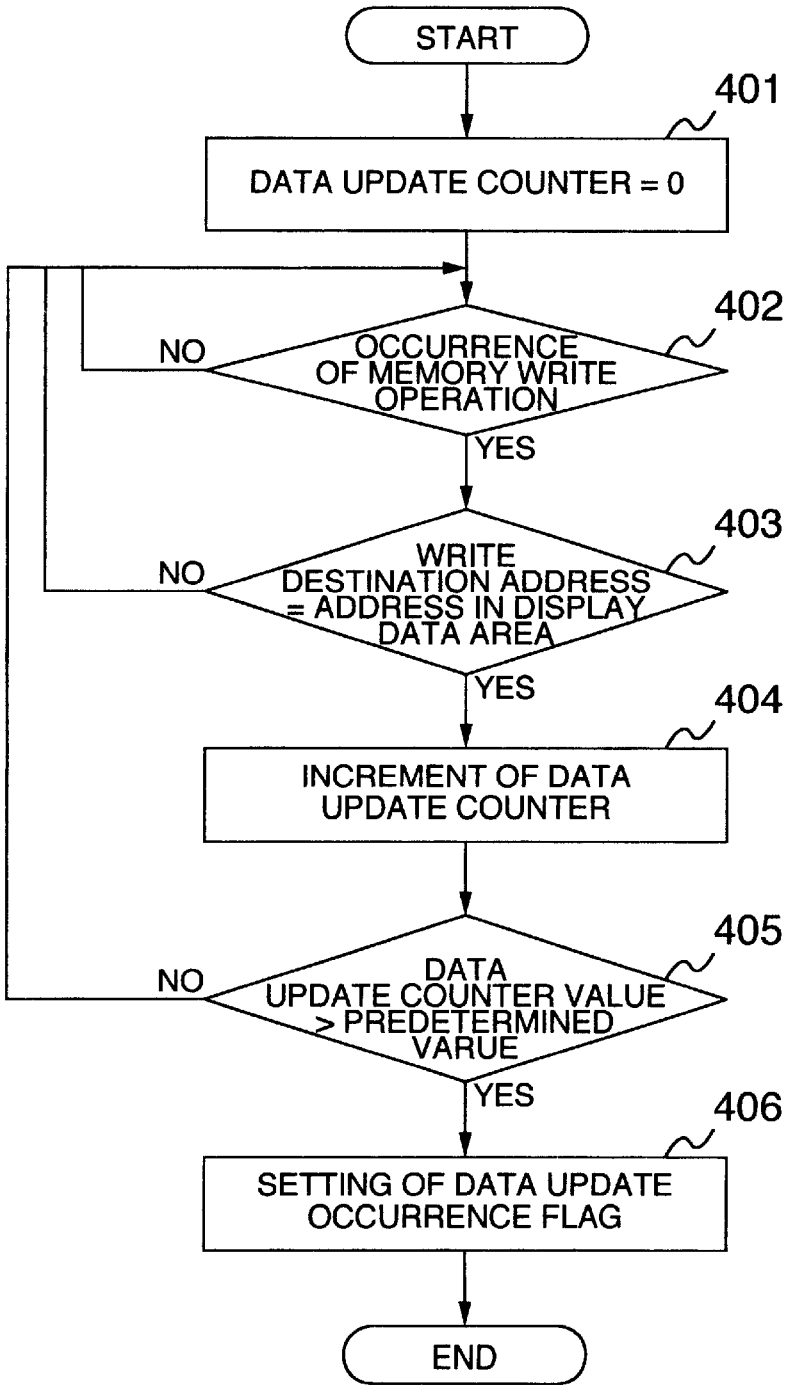
FIG. 4 is a simplified flow chart of another example of system display data update decision in the first embodiment.

As shown in FIG. 4, the rotation engine 107 has a data update counter and sets its initial value to 0 in step 401. The rotation engine 107 searches a write access to the system memory 105 by the CPU 101 by monitoring memory control signals on the system bus 102 in step 402.

When a memory write operation is detected, a memory address of a write destination is compared with a memory address in the display data area for system in step 403 to decide whether the memory write access is for update of display data. If the write destination address coincides with the address in the system display data area and the memory write access is determined to be for display data update, the data update counter is incremented in step 404.

The rotation engine 107 has a predetermined value of the number of data update operations and the predetermined value is compared with a value indicated by the data update counter in step 405. When a result of comparison indicates that the data update counter value exceeds the predetermined value, a display data update occurrence flag is set in step 406. Namely, when the number of display data update operations exceeds the predetermined constant value, the display data update occurrence is determined.

In FIG. 5, the display device display data update timing is determined by issuing the data update instruction when the display data update occurrence flag is set.

Figure 6:
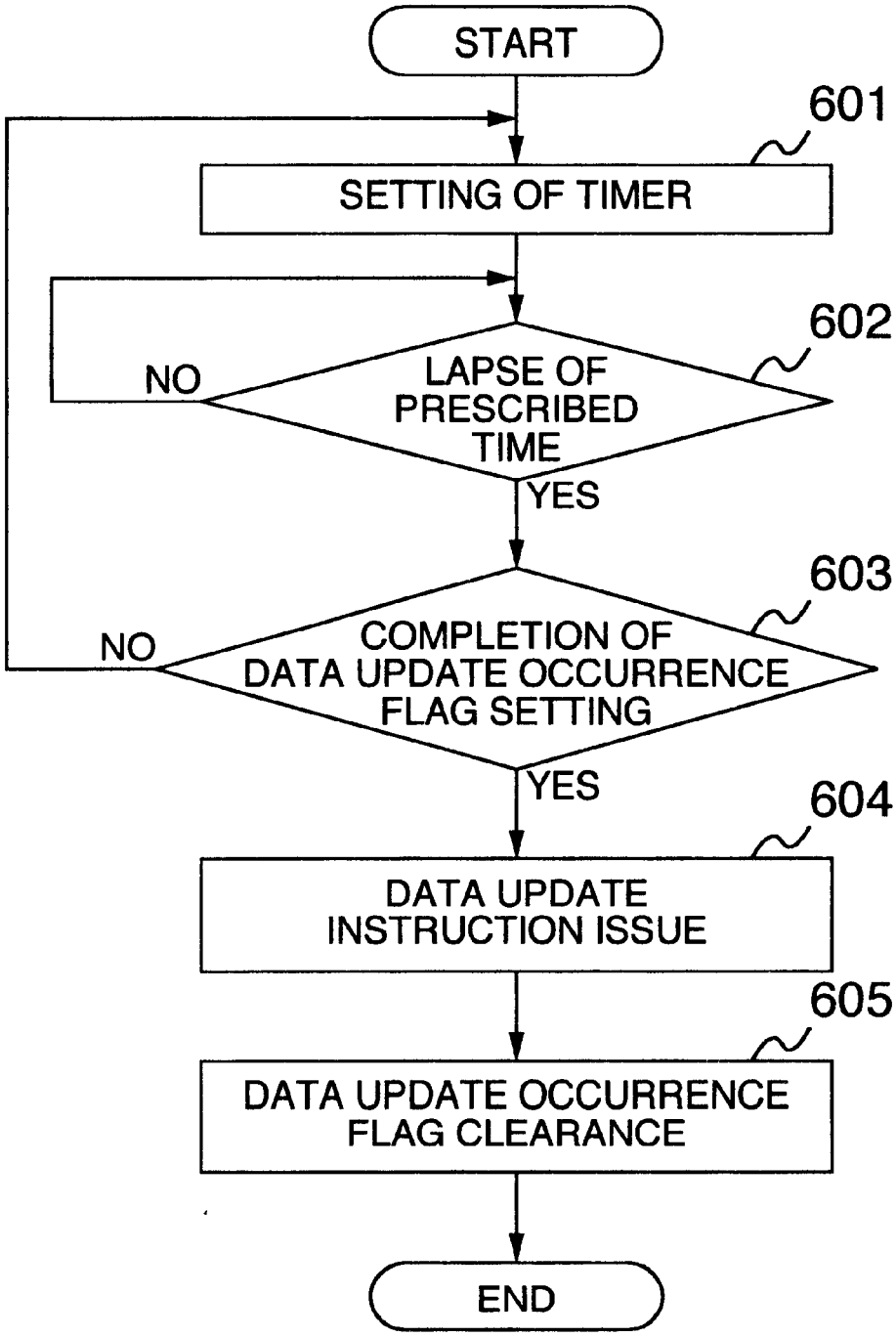
FIG. 6 is a simplified flow chart of another example of display data update timing determination in the first embodiment.

A different example of the display data update timing determination is carried out in accordance with a simplified flow chart shown in FIG. 6.

A time is set in the timer 106 in step 601. Each time that a prescribed time has elapsed, the rotation engine 107 monitors in steps 602 and 603 whether a display data update occurrence flag is set and if the display data update occurrence flag is set, the rotation engine issues a data update instruction in step 604 and at the same time clears the display data update occurrence flag in step 605. Namely, the display update occurrence flag is monitored at intervals of constant time and when the flag is set, the data update instruction is issued.

In FIG. 7, the update execution processing is shown in which an interrupt process is effected by the interrupt controller 117 and necessary display data is transferred by the bus master other than the rotation engine 107. A different example of the update execution is implemented in accordance with a simplified flow chart shown in FIG. 8.

More particularly, the rotation engine 107 monitors the presence or absence of issuance of a data update instruction in step 802 and if the data update instruction is issued, this is reflected on a data update register. The value of this register is monitored through polling by means of the CPU 101 in step 801. If the data update register shows the state of data update instruction issued, the following process is executed.

More specifically, the CPU 101 or the DMAC 116 acts as bus master to perform transfer of necessary display data between the system memory 105 and the rotation engine 107 in step 803. After the transfer of the necessary display data ends, the rotation engine 107 releases the data update instruction in step 804. In short, the CPU 101 or the DMAC 116 is requested to perform the display data update process through polling and execution of update of data within the display data area for display device is implemented by means of the bus master other than the rotation engine 107.

Figure 9:
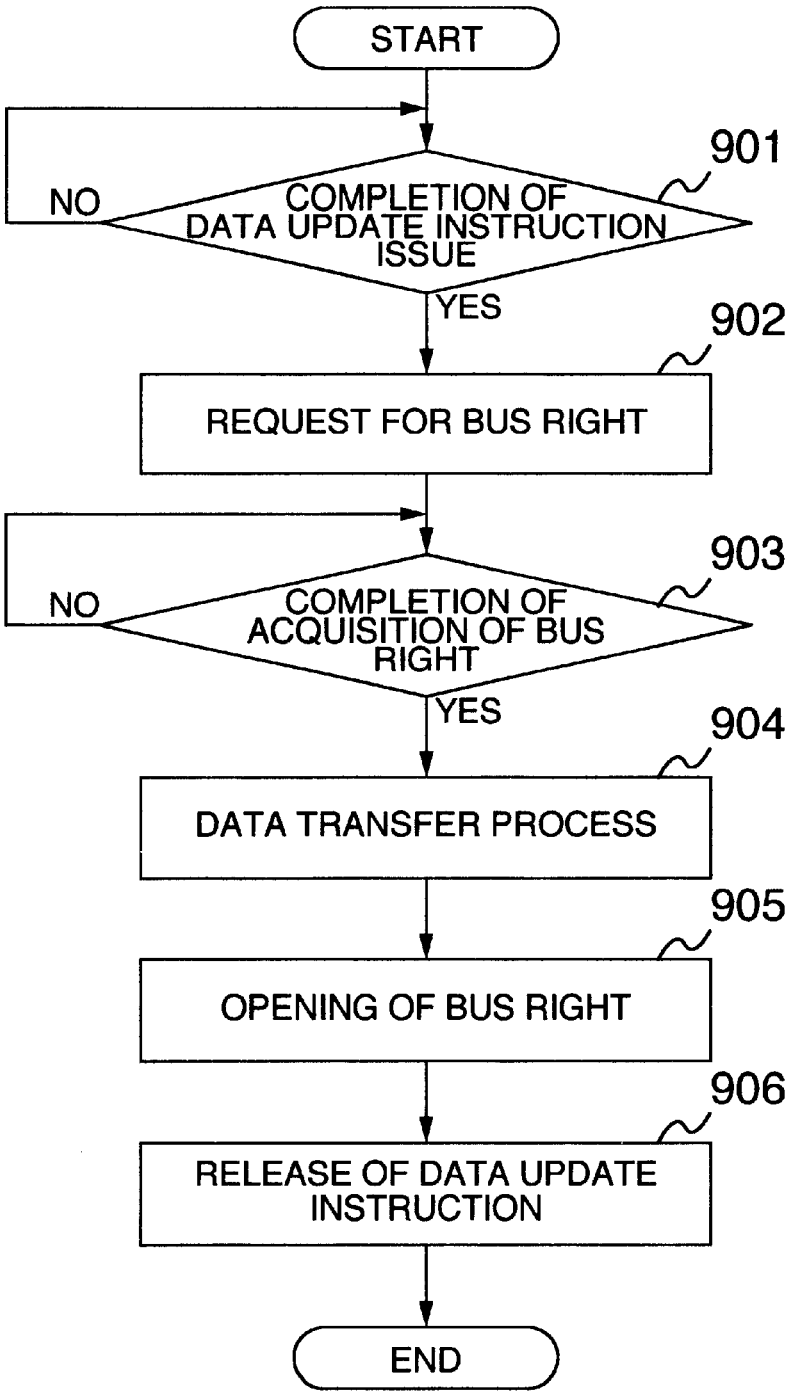
FIG. 9 is a simplified flow chart of still another example of display data update execution in the first embodiment.

Still another example of the update execution is implemented in accordance with a simplified flow chart shown in FIG. 9.

As shown in FIG. 9, the rotation engine 107 monitors the presence or absence of issuance of a data update instruction in step 901 and if the data update instruction is issued, the rotation engine requests the CPU 101 for right to use the system bus 102 in step 902. In response to this request, the CPU 101 carries out a necessary process and thereafter releases the bus right of the system bus 102 in step 903. Thus, the rotation engine 107 per se acts as bus master and performs necessary display data transfer between the system memory 105 and the rotation engine 107 in step 904. After the transfer of the necessary display data has ended, the rotation engine 107 opens the bus right to the system bus 102 in step 905 and releases the data update instruction in step 906. In short, the rotation engine 107 acts by itself as bus master to execute update of date within the display data area for display device.

Figure 8:
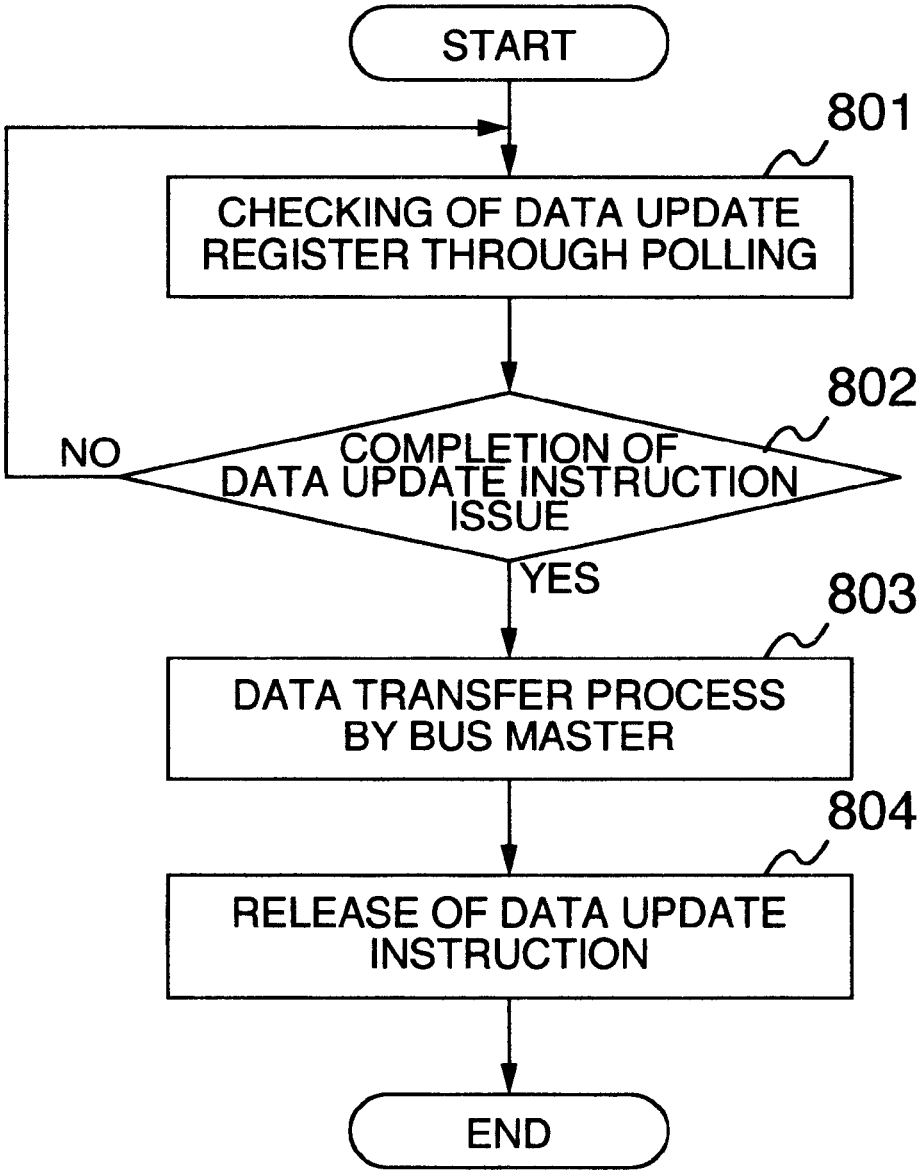
FIG. 8 is a simplified flow chart of another example of display data update execution in the first embodiment.

By limiting addresses in an object area subject to update within the display data area for system to the data update instruction shown in FIGS. 5 and 6, only data in a small area containing display pixels in the update object area can be subjected to the data transfer process shown in FIGS. 7, 8 and 9.

If the data transfer process shown in FIGS. 7, 8 and 9 is for updating the whole of the display data area without being aware of display pixels to be updated, it is not necessary to limit addresses in the update object area within the display data area for system to the data update instruction shown in FIGS. 5 and 6.

The timer 106, DMAC 116 and interrupt controller 117 have been described in connection with FIG. 1 but these units are not always needed depending on the system display data update decision method, the display device display data update timing determining method and the display device display data update execution method and in that case, the information processing apparatus according to the present embodiment need not be provided with these component units.

Referring now to FIGS. 2, FIGS. 11 to 13 and FIG. 17, a second embodiment of the information processing apparatus according to the invention will be described.

Figure 11:
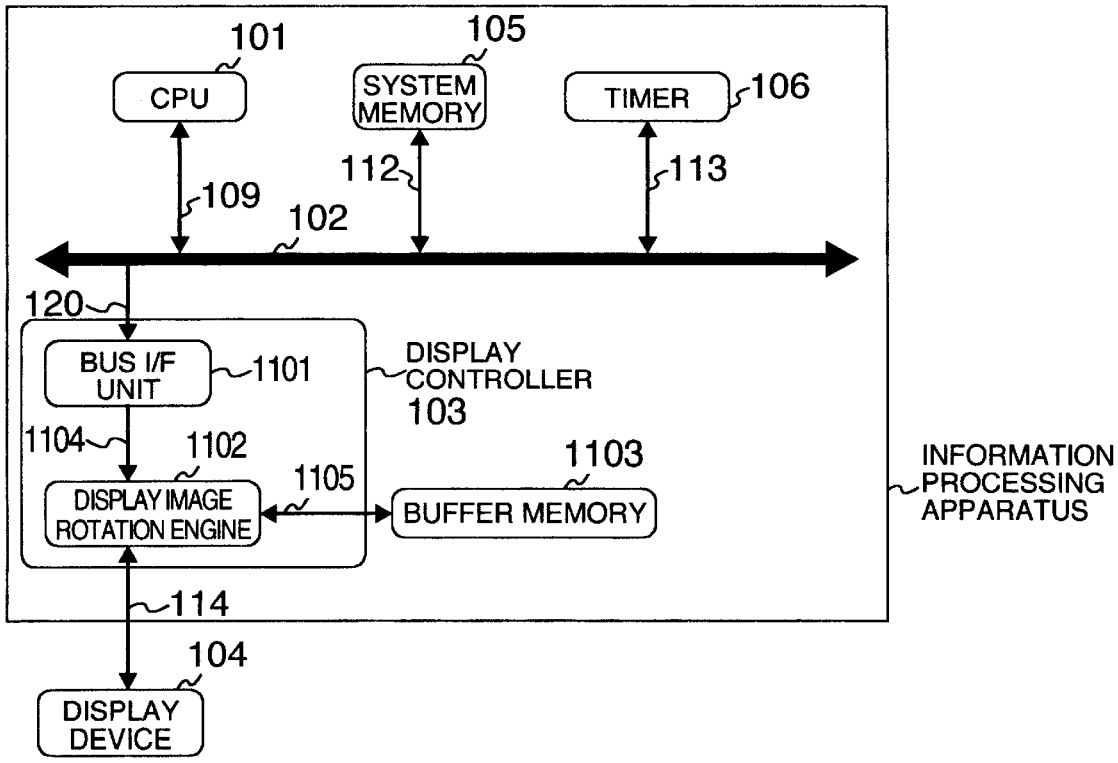
FIG. 11 is a diagram showing an outline of hardware construction of an information processing apparatus according to a second embodiment of the invention.

Especially, the hardware construction of the present embodiment is illustrated in FIG. 11.

In FIG. 11, components 101, 102, 104 to 106 and 109 to 113 are identical to those shown in FIG. 1 and a display controller 103 includes components 1101, 1102 and 1104.

In the figure, reference numeral 1101 designates a bus interface circuit (hereinafter referred to as a bus I/F unit) for receiving display data through the system bus 102, reference numeral 1102 designates a display image rotation engine for applying a rotation process to the display data delivered from the bus I/F unit 1101 and delivering the data directly to the display device, reference numeral 1103 designates a buffer memory which the rotation engine 1102 uses to work the rotation process, and reference numerals 1104 and 1105 designate data/control signal buses for interchange of data and control signals among individual component units.

Figure 17:
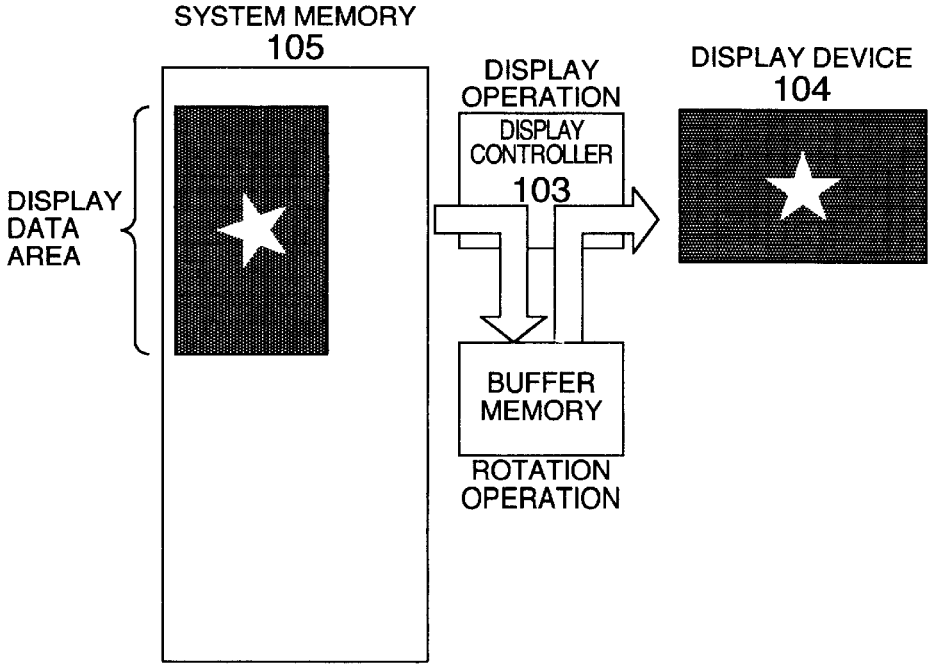
FIG. 17 is a diagram showing the concept of rotation display in the second embodiment of the information processing apparatus.

Turning to FIGS. 2 and 17, the concept of normal display and rotation display in the information processing apparatus according to the present embodiment will be described.

The concept of the normal display in the present embodiment is diagrammatically shown at (a) in FIG. 2 and the concept of the rotation display in the present embodiment is diagrammatically shown in FIG. 17.

As has been described in connection with the first embodiment, in the normal display shown at (a) in FIG. 2, the CPU 101 first writes display data corresponding to, for example, a display resolution of x*y pixels in the display area on the system memory 105. The display data is read by the display controller 103 and is displayed on the display device 104 having a display resolution of x*y pixels.

In the rotation display in the present embodiment shown in FIG. 17, display data corresponding to, for example, a display resolution of y*x pixels and written in the display data area is read by means of the display controller 103. Then, the read display data is 90° rotated, in this example, by means of the rotation engine 1102 included in the display controller 103 to provide display data corresponding to the x*y-pixel display resolution which in turn is displayed on the display device 104 of the x*y-pixel display resolution.

Next, the structure of the buffer memory 1103 and the operation of the rotation engine 1102 will be described with reference to FIGS. 12 and 13.

Firstly, reference is made to FIG. 12A–12E to describe the structure of the buffer memory 1103 when the normal display is carried out.

During the normal display, pieces of display data on the system memory 105, pieces of display data on the buffer memory 1103 and pieces of display data delivered to the display device are arranged as shown in FIG. 12A–12E. Especially, the display data pieces on the system memory 105 are shown in FIG. 12A, the display data pieces on the buffer memory 1103 are shown in FIG. 12B–12D and the display data pieces delivered to the display device are shown in FIG. 12E. For simplicity of explanation, it is assumed that a display data piece corresponding to one pixel of the display device 104 is stored at one address and the width of the data piece stored at one address is identical to the bus width of the system bus 102. Namely, the display data pieces on the system memory 105 are held in an area of (m+1)*(n+1) addresses and the display device 104 has a display resolution of (m+1)*(n+1) pixels. The buffer memory 1103 has two memories 1 and 2 each having a capacity corresponding to (m+1) pixels, that is, display data pieces on one line of the display device. The horizontal direction in FIG. 12A corresponds to the direction of addresses on the same row.

When individual pixel data pieces are displayed in an arrangement shown in FIG. 12E on the display device 104, the display controller 103 must deliver the display data pieces in order of 00, 01, 02, . . . , 0*m*, 10, 11, 12, . . . , 1*m*, . . . , n0, n1, n12, . . . , nm at timings requested by the display device 104.

With the aim of absorbing the difference between the transfer speed of display data inputted to the display controller 103 by way of the system bus 102 and the display data transfer speed requested by the display device 104, the aforementioned two memories 1 and 2 are switched so that the display data may be written to one of the two memories and at the same time the display data may be read out of the other, thereby assuring the display data transfer speed requested by the display device 103. If time required to complete delivery of the display data stored in one memory 1 or 2 is "1", then time required to complete delivery of display data for one picture frame will be "n+1". As shown in FIG. 12D, data pieces on the first row are again stored in the memory 1 of buffer memory 1103 at time n+1 and the process shown in FIG. 12C–D is executed repetitively.

Referring now to FIG. 13A–13E, the buffer memory 1103 has a structure shown therein when the rotation display is carried out.

Display data pieces on the system memory 105, display data pieces on the buffer memory 1103 and display data pieces to be delivered to the display device are arranged as shown in FIG. 13A–13E during execution of the rotation display. Especially, the display data pieces on the system memory 105 are shown in FIG. 13A, the display data pieces on the buffer memory 1103 are shown in FIG. 13B–13D and the display data pieces delivered to the display device are shown in FIG. 13E. Similarly to the case of the normal display, it is assumed for simplicity of explanation that a display data piece corresponding to one pixel of the display device 104 is stored at one address and the width of the data piece stored at one address is identical to the bus width of the system bus 102. In other words, the display data pieces on the system memory 105 are held on an area of (n+1)*(m+1) addresses and the display device 104 has a display resolution of (m+1)*(n+1) pixels. The horizontal direction in FIG. 13A corresponds to the direction of addresses on the same row.

As described previously, when a DRAM is used as system memory 105, only data pieces on the same row can be subjected to execution of burst access capable of performing sequential data read and data write. The number of burst access operations for the best data transfer efficiency is determined depending on the system construction but for simplicity of explanation, it is assumed as in the case of the first embodiment that the number of burst transfer operations between the rotation engine 1102 and the system memory 105 is four per access.

In this case, the buffer memory 1103 has two memories 1 and 2 each having a capacity of (m+1)*4 pixels, that is, corresponding to display data pieces of (pixels on one line of display device 104)*(the number of burst transfer operations). As shown in FIG. 13B, the display data pieces can be transferred from the system memory 105 to the memory 1 of buffer memory 1103 through the burst access in order of (0*m*, 1*m*, 2*m*, 3*m*), . . . , (08, 18, 28, 38), (07, 17, 27, 37), . . . , so that display data pieces for a plurality of lines of the display device corresponding in number to the number of burst transfer operations can be assured without impairing the data transfer speed. Then, as shown FIG. 13C, by delivering the data pieces from the memory 1 of buffer memory 1103 to the display device 104 in order of 00, 01, 02, 03, . . . , 0*m*, 10, 11, 12, 13, . . . , 1*m*, . . . , display data pieces subjected to 90° rotation can be delivered. By switching the two memories 1 and 2 of buffer memory 1103 so that display data pieces may be written to one memory 1 or 2 and concurrently display data pieces may be read out of the other, the display data transfer speed requested by the display device 103 can be assured. If time required to complete delivery of display data pieces stored in one buffer memory 1 or 2 is "1", then time required to complete delivery of display data pieces for one picture frame will be "(n+1)/4". As shown in FIG. 13D, the same data pieces as those stored in the memory 1 shown in FIG. 13B are again stored in the memory 1 at time (n+1)/4 and the process shown in FIG. 13C–13D is executed repetitively.

As described above, by using the rectangular memories 1 and 2 of buffer memory each having a length of one side corresponding to a capacity of display data transferred by a number of burst transfer operations determined between the system memory 105 and the display controller 103 and a length of the other side corresponding to a capacity of display data for one line of the display device 104, the buffer memory 1103 can have the structure which can permit the high data transfer efficiency and saving of memory capacity. In the above description given by using FIG. 13A–13E, for simplicity of explanation, one pixel data piece is stored at one address and the data piece width at one address is identical to the bus width of the system bus 102. But even when the above presupposition is not satisfied, a buffer memory capable of permitting the high data transfer efficiency and memory capacity saving can be constructed by changing the sequence of data pieces held in the rotation engine 1102 through the burst transfer, within the bus width and the data piece width at one address.

While, in the above description using FIG. 13, the method is explained in which the display data is 90° rotated, 270° rotation can be realized easily by changing the directions of data read and data write.

As will be seen from the above, according to the present embodiment, in the system in which the control instructions, system data and display data coexist in the system memory, the information processing apparatus and its display controller can be provided which can permit the rotation display by using the buffer memory of small capacity without increasing the band of the system bus.

Figure 14:
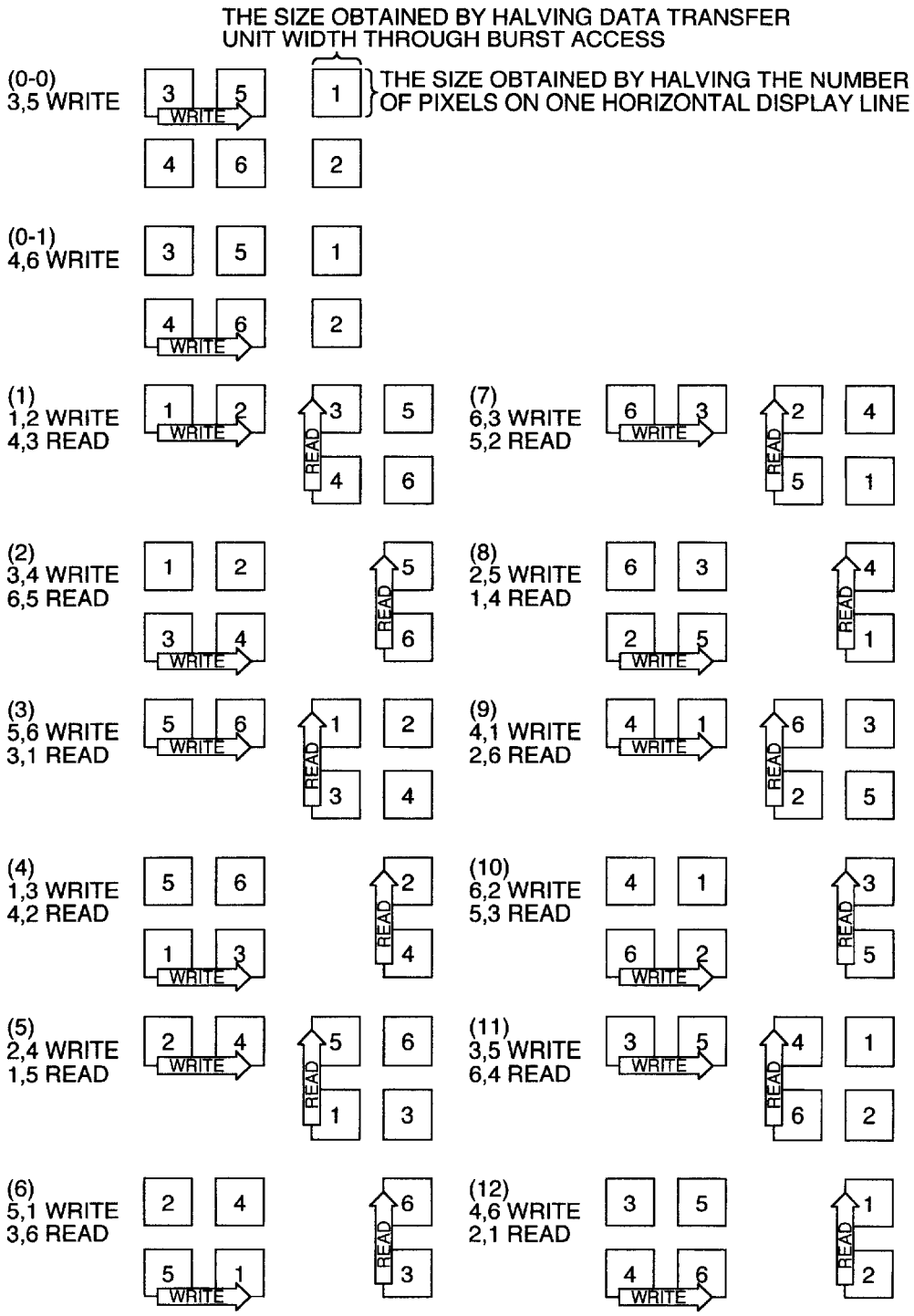
FIG. 14 is a diagram showing an outline of structure of a buffer memory used by a display controller in an information processing apparatus according to a third embodiment of the invention.

Referring now to FIGS. 11 and 14, a third embodiment of the information processing apparatus according to the present invention will be described. The hardware construction of the present embodiment is identical to that of the second embodiment shown in FIG. 11.

Especially, an example of structure of the buffer memory 1103 used by the display controller 103 in the present embodiment is diagrammatically outlined in FIG. 14.

In the present embodiment, where the data capacity transferred through burst transfer operation is L, the data capacity of a line on the display device 104 is m and each of the L and m is equally divided by n, the buffer memory 1103 has n*n+n rectangular unit memories each having a length of one side (x direction) corresponding to L/n display data pieces and a length of the other side (y direction) corresponding to m/n display data pieces.

In other words, when n unit memories are aligned in x direction, the total n provides a capacity which can store display data pieces transferred through burst transfer operation in a row of direction. When n unit memories are aligned in the y direction, the total n provides a capacity which can store display data pieces corresponding to the data capacity of a line on the display device 104 in a column of y direction. The rotation engine 1102 writes display data pieces in n unit memories aligned in x direction, L pieces by L pieces. At the same time, the rotation engine 1102 reads display data pieces out from n unit memories aligned in v direction, m pieces by m pieces.

For simplicity of explanation, n is set to 2 in FIG. 14 to show the structure of the buffer memory 1103. A unit memory is rectangular, having a length of one side (x direction) corresponding to ½ of the display data capacity transferred through burst transfer operations and a length of the other side (y direction) corresponding to ½ of the display data capacity of a line on the display device 104. Then, 6(=2*2+2) unit memories are used. For the purpose of explanation, individual unit memories are assigned with numerals 1 to 6. In the initial state indicated at sections (0—0) and (0–1), display data pieces are stored in the buffer.

The operation of the buffer during the rotation display is indicated at sections (1) to (12). Similarly to the second embodiment shown in FIG. 13, display data is inputted in a direction in which the burst transfer operation can be effected and display data is delivered in a direction required by the display device 104. In both the write and read directions, an access in common to both the two unit memories is carried out to assure a necessary capacity. Unit memories which are connected in y direction at a time point to permit display data to be read out of these unit memories are connected in x direction at a subsequent time point to permit display data to be written to these unit memories. After the operation shown at (12) in FIG. 14, the operation shown at (1) in FIG. 12 proceeds and then the process is executed repetitively.

With the buffer memory of the above structure used for the rotation engine 1102 in the present embodiment, the unit memory capacity can be reduced. Namely, by increasing n, the total memory capacity of the buffer memory can theoretically approach ½ of that required in the second embodiment.

As described above, according to the present embodiment, in the system in which control instructions, system data and display data coexist in the system memory, the information processing apparatus and its display controller can be provided which can perform the rotation display by using the buffer memory of smaller capacity without increasing the band of the system bus.

Figure 15:
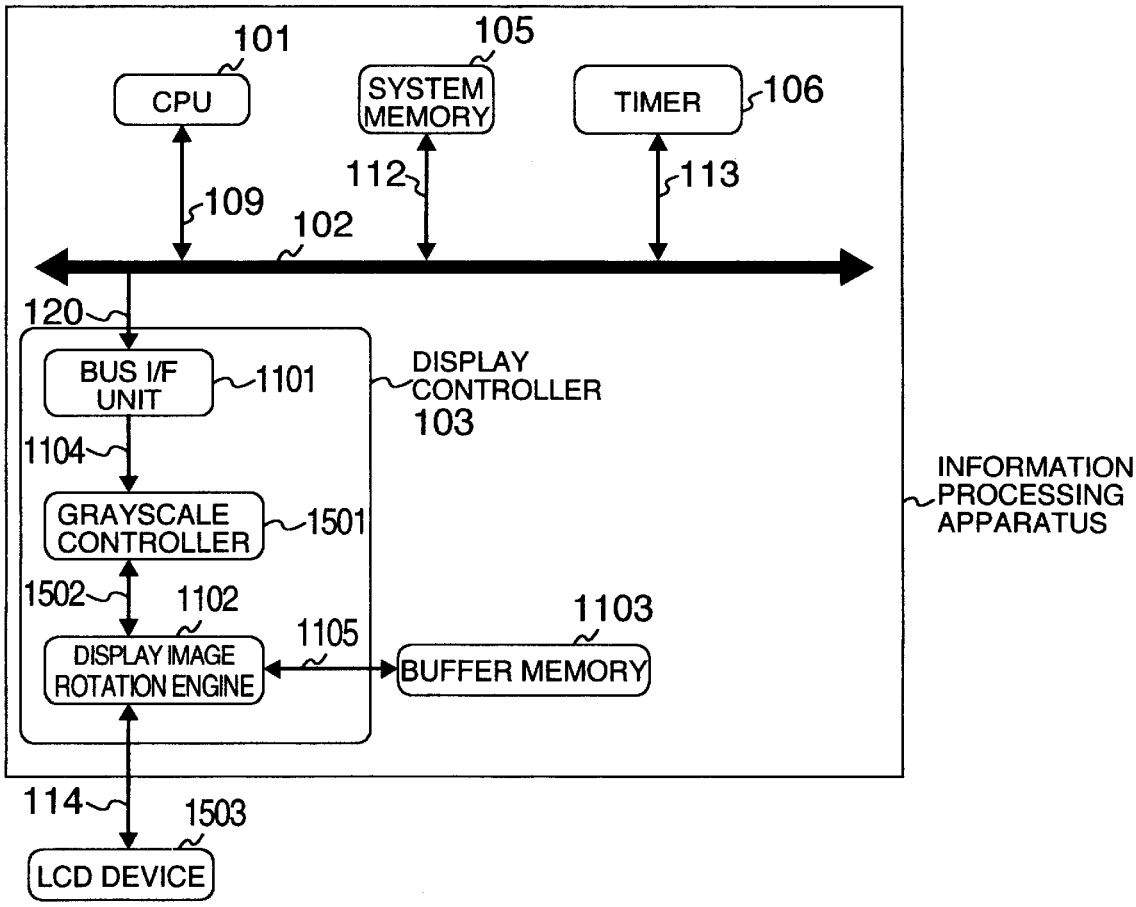
FIG. 15 is a diagram showing an outline of hardware construction of an information processing apparatus according to a fourth embodiment of the invention.
Figure 16:
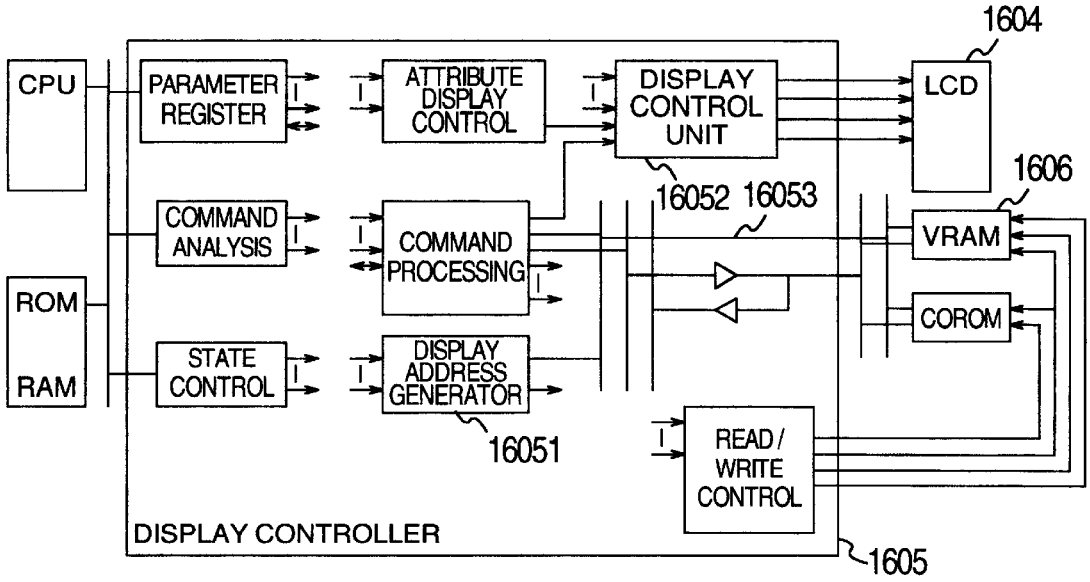
FIG. 16 is a diagram showing an outline of hardware construction of a conventional information processing apparatus.

Referring to FIGS. 13 to 15, a fourth embodiment of the information processing apparatus according to the present invention will be described.

The construction of the information processing apparatus according to the present embodiment is outlined in FIG. 15 and hardware construction of the present embodiment will first be described briefly by making reference to FIG. 15.

In FIG. 15, components 101 to 102, 105 to 106 and 109 to 113 are identical to those shown in FIG. 1 and components 1101 to 1105 are identical to those shown in FIG. 11.

A display controller 103 of the information processing apparatus according to the present embodiment additionally includes components designated by reference numerals 1501 and 1502.

In the figure, reference numeral 1503 designates a liquid crystal display (LCD) device. A grayscale controller 1501 converts display data into grayscale data necessary for display on the LCD device, by using of, for example, frame rate control (FRC). A data/control signal bus 1502 is used for interchange of data and control signals between individual components.

In the present embodiment, the buffer memory may have the structure shown in either FIG. 13 or FIG. 14. Even when 16 bits or 24 bits, for example, are used for one pixel in the original display data, grayscale data for LCD device generated by the grayscale controller is 1 bit for monochromatic display and 3 bits for color display. Consequently, the buffer memory capacity required for performing rotation display by using the grayscale data can be smaller than that required for performing rotation display by using the display data.

As described above, according to the present embodiment, in the system in which control instructions, system data and display data coexist in the system memory, the information processing apparatus and its display control unit can be provided which can perform the rotation display by using the buffer memory of smaller capacity without increasing the band of the system bus.

Thus, according to the present embodiment, the information processing apparatus or the display controller can execute 90°, 180° and 270° rotation display without sacrificing the display performance.

What is claimed is:

1. An information processing apparatus comprising:

a rectangular memory unit having a first and a second display areas for display data;

a processing unit for processing and storing display data in said first display area of said memory unit;

a display image rotation engine which includes a buffer memory and is coupled with said processing unit, and said first and second display areas of said memory unit, for sequentially reading the display data from said first display area and storing said display data in said second display area of said memory unit in a different sequence than stored by said processing unit in response to a command of predetermined timing for display data rotation, wherein said rotation engine sequentially reads and stores mL display data pieces stored on the same row of n columns in said memory unit row by row into said buffer memory, and reads and stores nL display data pieces stored on the same column of m rows in said buffer memory column by column into said second area of said memory unit, where L is a data unit transferred;

a display controller for delivering the display data stored in said second area of said memory unit by means of said rotation engine to a display device; and a bus for mutually coupling said processing unit, said memory unit, said display controller and said rotation engine.

2. An information processing apparatus according to claim 1, wherein in said rotation engine, the update timing is determined by a command provided through said bus from said processing unit.

3. An information processing apparatus according to claim 1, wherein in said rotation engine, the update timing is determined by a predetermined number of operations for updating said display data.

4. An information processing apparatus according to claim 1, wherein in said rotation engine, the update timing is determined each time a predetermined time has elapsed.

5. An information processing apparatus according to claim 1, wherein said buffer memory has at least two areas and while display data from said first area of said memory unit is written to one area, display data is read out of the other area and delivered to said second area of said display controller.

6. An information processing apparatus according to claim 1, wherein said processor processes display data in a manner that said processed data is not rotated before writing in said first display area of said memory unit.

7. An information processing apparatus comprising:

a processing unit;

a memory unit for storing display data processed by said processing unit;

a display controller for delivering the display data to a display device;

a display image rotation engine coupled with a buffer memory, the buffer memory having n×n areas added with +n areas connected to said n×n areas each being adapted to store display data pieces corresponding to m/n×L/n display data, where L is a predetermined number of display data transferred in an access under burst access mode in the display data on the same row, m is the number of rows and n is a numeral for equally dividing each of the L and m, said display image rotation engine while sequentially writing display data pieces for m rows each of n columns in a unit of L data pieces, that is, L pieces by L pieces to said n×n areas, reads display data pieces for m pixels on the same column, column by column, from the remaining added n areas and writes sequentially display data pieces to said n added areas for which read operation has ended; and a bus for mutually coupling said processing unit, said memory unit, said display controller and said rotation engine, wherein addresses of display data in the buffer memory after a display rotation are determined by changing the output sequence of the display data in the buffer memory in relation to the input sequence of the display data in the buffer memory.

8. An information processing apparatus according to claim 7, further comprising:

at least one memory area for use to write; and at least one memory area for use to read in the read operation.

9. A display controller coupled to a processing unit and a memory unit for storage of display data processed by said processing unit to deliver the display data to a display device, comprising:

a bus interface receiving display data processed in said processing unit;

a first rectangular buffer memory having a capacity for one line displayed on said display device with a number of burst transfer operations;

a second rectangular buffer memory having the capacity for one line displayed on said display device with the number of burst transfer operations;

a display image rotation engine which is coupled with said bus interface, and first and second rectangular buffer memories to sequentially transfer the display data to said first and second buffer memories and which responds to a command of predetermined timing for data update to deliver the display data stored in said buffer memory, to said display controller in read sequence of display data different from write sequence, wherein addresses of display data in the first and second buffer memories after a display rotation are determined by changing the output sequence of the display data in one of the first and the second buffer memories in relation to the input sequence of the display data in another of the first and second buffer memories.

10. An information processing apparatus comprising:

a processing unit for processing display data;

a memory unit for display data processed by said processing unit;

a display controller for delivering the display data to a display device;

a display image rotation engine coupled with said processing unit and a buffer memory, said buffer memory having a plurality of areas each connected to each other to store mL display data transferred into columns each of n rows, said display image rotation engine sequentially selecting said plurality of areas in a manner to write mL display data column by column in m rows of said buffer memory and sequentially selecting said plurality of areas in said manner to read said mL display data row by row from each area of said plurality of areas; and a bus for mutually coupling said processing unit, said storage unit, said display controller and said rotation engine, wherein addresses of display data in the buffer memory after a display rotation are determined by changing an output sequence of the display data in the buffer memory in relation to an input sequence of the display data in the buffer memory.

11. An information processing apparatus according to claim 10, wherein said processor processes display data in a manner that said processed data is not rotated before transferring to said bus interface.

12. An information processing apparatus according to claim 10, wherein said rotation engine is provided within said display controller.

* * * * *